US006640509B2

(12) United States Patent
Clewis

(10) Patent No.: US 6,640,509 B2
(45) Date of Patent: Nov. 4, 2003

(54) APPARATUS FOR ASSISTING IN SECURING A PROTECTIVE STRUCTURE OVER A WINDOW OR DOOR

(75) Inventor: Dale M. Clewis, River Ridge, LA (US)

(73) Assignee: Gateway Manufacturing, Inc., Mt. Sterling, KY (US)

( * ) Notice: Subject to any disclaimer, the term of this patent is extended or adjusted under 35 U.S.C. 154(b) by 0 days.

(21) Appl. No.: 09/853,435

(22) Filed: May 10, 2001

(65) Prior Publication Data

US 2002/0017065 A1 Feb. 14, 2002

Related U.S. Application Data

(60) Provisional application No. 60/213,683, filed on Jun. 23, 2000.

(51) Int. Cl.[7] ..... E06B 3/26

(52) U.S. Cl. ..... 52/202; 52/DIG. 12; 49/55; 49/57; 248/200.1; 248/354.3; 248/354.5

(58) Field of Search ..... 52/202, 126.6, 52/126.3, 662, DIG. 12; 49/54, 55, 57, 50; 248/200.1, 208, 354.3, 354.5, 231.2, 168.5, 354.7, 222.14; 410/151, 145

(56) References Cited

U.S. PATENT DOCUMENTS

| | | | | | |
|---|---|---|---|---|---|
| 446,480 | A | * | 2/1891 | Stebbins | 49/55 |
| 570,713 | A | * | 11/1896 | Pardee et al. | 49/57 |
| 1,532,769 | A | * | 4/1925 | McElroy | 49/57 |
| 2,584,706 | A | * | 2/1952 | Hulsey, Jr. | 49/55 |
| 2,794,217 | A | | 6/1957 | Croft | |
| 2,928,146 | A | * | 3/1960 | Kuniholm | 49/55 |
| 3,216,482 | A | * | 11/1965 | Lindholm | 49/55 |
| 3,802,690 | A | * | 4/1974 | Tavano | 52/202 |
| 3,968,607 | A | | 7/1976 | Baran | |
| 4,085,788 | A | | 4/1978 | Bernardo | |
| 4,118,911 | A | | 10/1978 | Lewchuk | |
| 4,149,342 | A | * | 4/1979 | Bowers | 49/55 |
| 4,590,706 | A | | 5/1986 | Plowman | |
| 4,633,612 | A | * | 1/1987 | Forkish | 49/55 |
| 4,671,012 | A | | 6/1987 | Merklinger et al. | |
| 5,335,452 | A | * | 8/1994 | Taylor | 49/463 |
| 5,383,509 | A | | 1/1995 | Gaffney et al. | |
| 5,507,118 | A | | 4/1996 | Brown | |
| 5,673,883 | A | | 10/1997 | Figueroa, Jr. | |
| 5,709,054 | A | | 1/1998 | McGillivray | |
| 5,833,081 | A | | 11/1998 | Smith | |
| 5,937,593 | A | | 8/1999 | White | |
| 5,943,832 | A | | 8/1999 | Russell | |
| 6,233,877 | B1 | * | 5/2001 | Monroe | 52/37 |
| 6,330,768 | B1 | * | 12/2001 | Rodrigues | 52/202 |
| 6,371,422 | B1 | * | 4/2002 | St. Martin et al. | 248/200.1 |

* cited by examiner

*Primary Examiner*—Cari D. Friedman
*Assistant Examiner*—Yvonne M. Horton
(74) *Attorney, Agent, or Firm*—King & Schickli, PLLC

(57) ABSTRACT

An adjustable length bracing device can be installed in a window frame or door frame to secure a sheet of covering material that is positioned to protect the window or door from flying debris resulting from a hurricane, tornado, or other storm. The brace device consists of two independent and moveable bars, which can be adjusted to fit the inside of a window or door opening. The adjustment is made by the use of a metal clip attached to one bar and inserted into a notch on the other bar. The ends of each bar have rubber pads to help prevent marring the window or door opening or frame and to prevent any slipping of the bracing device assembly. Once the assembly is in position, a locking metal ring holds both independent bars together to prevent movement.

29 Claims, 4 Drawing Sheets

10A
14
31
28
42
25
24
29
45
21
40
26
13

32
46 d

APPARATUS FOR ASSISTING IN SECURING A PROTECTIVE STRUCTURE OVER A WINDOW OR DOOR

CROSS-REFERENCE TO RELATED APPLICATIONS

Priority of U.S. Provisional Patent Application Ser. No. 60/213,683, filed Jun. 23, 2000, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the protection of windows and doors from wind damage. More particularly, the present invention relates to devices that protect windows from high velocity winds and flying objects that are hurled about during high velocity wind storms, hurricanes, tornadoes and like storms.

2. General Background of the Invention

In areas of the country that are hit by violent wind storms, it is common to fasten (e.g. with nails, bolts, sheet metal screws, wood screws) sheets of protective material over windows in an attempt to prevent glass breakage. The glass in windows can be broken by high velocity winds. The glass in windows can also be broken by projectiles that are launched by these high velocity winds. Tree branches, gravel, trash cans and many other objects are hurled through the air during violent wind storms such as hurricanes, tornadoes and the like.

One of the most common preventative measures for protecting windows is to cover the window with a sheet of protective sheet material such as plywood. Fastening sheets of plywood to a window that is to be protected can be a time-consuming and often difficult job. Many of the windows in question are aluminum frame windows. It is difficult to attach a plywood sheet to an aluminum frame window using nails, screws or other fasteners without causing collateral damage. Wood screws generate unsightly holes in wood windows and can crack the wood and/or glass portions of the window if improperly or hastily installed.

Many patents have issued that disclose devices for protecting windows during wind storms. Some of these patented devices include a bracing arrangement for protecting the window and/or for holding a sheet of protective material in place.

One such patent is U.S. Pat. No. 2,794,217 entitled "Hurricane Brace for Windows", issued to L. T. Croft. The '217 patent discloses a hurricane brace for a window that comprises a support formed rigid from end to end and comprising a pair of tubular sections and axial alignment with their adjacent ends spaced from each other. A socket is provided connecting the adjacent ends and provided there between with a solid portion. Means at the remote ends of the tubular sections is provided for clamping engagement against opposite parallel stationary surfaces adjacent the window, the solid portion of the socket being provided with a diametrical opening therethrough. A stem is axially movable in such opening, and a glass engaging plate is carried by the stem and engageable against the inner surface of the window.

The Baran U.S. Pat. No. 3,968,607 discloses an apparatus for use on a window for counteracting the stress on the window pane when subjected to high wind pressure. The apparatus has a bracket extending from one side of the window frame to the other and spaced from the window pane. A pressure plate is positioned against the window pane and a connector arm extends from the bracket to the pressure plate to retain the pressure plate against the window pane.

A reinforcing means for a closure having a slatted articulated shutter for openings in a wall of a building is disclosed in U.S. Pat. No. 4,085,788 entitled "Reinforcing Means for Roll-up Shutter".

A tool for installing a pane to an existing glazing to provide an insulating sealed air space there between is disclosed in U.S. Pat. No. 4,118,911.

A protective device for panes of windows and glass doors is disclosed in the Plowman U.S. Pat. No. 4,590,706. The '706 patent discloses a device for protecting panes of windows and glass doors that consists of a beam which may be removably engaged in mounting brackets at the sides of, or above and below the pane. The beam is parallel to and spaced from the pane and one or more pressure pads is mounted on the beam for movement to an operative position against and applying pressure to the inside face of the pane to counteract vibration or flutter of the pane. The beam may have a pelmet fascia fixed to it and when not in use, may be supported inconspicuously above the window or door.

A security barrier is disclosed in U.S. Pat. No. 4,671,012 that is adapted to bar an opening such a window or door of a house.

A kit for door reinforcement, for use with a building having a sectional overhead door and at least one vertically disposed strut for reinforcing the door against wind damage is disclosed in U.S. Pat. No. 5,383,509 issued to Gaffney et al.

U.S. Pat. No. 5,507,118 discloses a window guard provided for a window which may be removably mounted in a window frame to protect the window from storms. The window includes a window frame having frame members, two of which have holes formed on inwardly facing surfaces. The window guard includes a board sized to fit within the window frame and a brace or mounting mechanism pivotally mounted on the board which cooperates with the window frame holes to mount the window guard in the frame. The mounting mechanism includes a cross-member pivotally secured to the board and rods telescopingly received in the cross-member. The cross-member is made of two elongate pieces which are pivotally connected and which have blind bores formed in their ends which telescopingly receive the rods. The rods can thus telescope to a position in which they extend from the cross-member into the holes formed in the window frame and be retracted to a position in which they do not extend beyond the edges of the board. A screw is provided for each rod to be screwed against the rod to secure the rod in a desired position in the cross-member. Guide brackets are positioned near the edges of the board to provide a guide through which the rods extend.

The Figueroa, Jr. U.S. Pat. No. 5,673,883 discloses a bar device which can be installed in a window opening to which a sheet of covering material can be secured to protect the window from flying debris resulting from a storm such as a hurricane, tornado, etc. The bar device includes a turnbuckle which is threaded on its opposite ends. Threaded rods are threaded into the turnbuckle. A threaded bolt is secured in some manner to each of the threaded rods to extend perpendicular thereto. A supporting pad is secured at the ends of the threaded rods and the supporting pads are forced against a wall elements defining a window opening in order to secure the bar device in the window opening and a protective cushion is provided on the supporting pads to prevent marring the window opening. Once the bar device is secured in the window opening, the covering sheet such as plywood is secured in place by passing the threaded bolts through suitable holes in the covering sheet and then securing the covering sheet in place by a washer and nut applied onto the threaded bolts.

A window brace is disclosed in U.S. Pat. No. 5,709,054 that includes a vertically disposed pole to which is coupled one or more braces, each of which includes a pad bearing against a portion of a surface of unsupported glass. Each pad defines an internal chamber connected to ambient atmosphere by a check valve such that when the glass bows inwardly toward the pad, air is forced out of the chamber via the check valve that prevents air from returning into the chamber. Evacuation of the chamber, in this way, enhances adherence of the pad to the window glass and thus, enhances effectiveness of the inventive device. For large pieces of window glass, a plurality of pads may suitably be employed. Alternatively, a valved port in the pad may be connected to a source of vacuum to evacuate the chamber.

U.S. Pat. No. 5,833,081 discloses a universal hanger placed between opposed surfaces within a motor vehicle and provides a temporary support of articles of clothing.

The White U.S. Pat. No. 5,937,593 discloses a security closure adapted to be secured over windows or other openings in a wall of a building. The security closures are fixed to the building in a manner to substantially prevent removal of the closure from the exterior of the building. On the other hand, the security closures provide ways to secure the security closures from the interior of the building while minimizing any obstruction to work being done inside the building.

U.S. Pat. No. 5,943,832 discloses a flood or storm resistant barrier for a doorway or window opening. The barrier formed of a frame having two parts with one part in telescopic engagement with the other frame part. A manually operable jack in the form of four links pivotally connected to form a parallelogram linkage is inserted between the two frame parts. The jack being operable to move the frame parts relative to one another so as to vary the external dimension of the frame and thereby enable the frame to be secured in a doorway or window opening by expansion of the frame into engagement with opposed surfaces of the doorway or window opening. A waterproof barrier member is carried by the frame for blocking at least a portion of the doorway or window opening.

An adjustable child fence is manufactured by Gerry Corp. of Suring, Wis., model no. 201/202. This fence uses wood bar members that are connectable together in an overlapping fashion.

The following U.S. Patents are incorporated herein by reference: U.S. Pat. Nos.: 5,943,832; 5,937,593; 5,833,081; 5,709,054; 5,673,883; 5,507,118; 5,383,509; 4,671,012; 4,590,706; 4,118,911; 4,085,788; 3,968,607; and 2,794,217.

BRIEF SUMMARY OF THE INVENTION

The present invention provides an improved window protection apparatus and method for protecting glass portions of a window or door that is mounted in a recess of a surrounding wall of a building.

The method includes the use of an expanse of sheet panel material for covering the window or door, the panel material being sized and shaped to fit over the window or door and to occupy the wall recess.

The apparatus includes an adjustable retaining brace that secures a selected panel in the recess. The brace includes a first bar member having first and second end portions, the first end portion having a first connector.

A second bar member has first and second end portions and a plurality of notches spaced at intervals along at least a portion of the length of the second bar member.

The notches of the second bar member define recess portions that enable a connection to be formed between the first connector and the second bar member at a selected position defined by a selected notch.

A second connector is removable from both bar sections and enables a connection to be formed between the first bar member and a second bar member at a position spaced away from the first connector and at a location defined by a selected notch.

The bars can be preliminarily connected together using the first connector. Once connected, the bars are of a combined length that can be selectively chosen to be slightly larger than the distance between one side of the recess (or window frame) and an opposing side. In order to fit the recess, the connected bars can be angled relative to one another to assume an angled position. In the angled position, both bars can occupy the recess or the window frame. The angled bars can then be rotated from the angled position to a generally aligned, interference fit position that generates an interference fit between the aligned bars and window frame or the window frame or building wall at the recess. The interference fit position of the bars enable the bars to tightly connect with the surrounding building wall or window frame, discouraging removal of the so-connected bars and the retained panel.

In the preferred embodiment, the bars are of about the same size and length. In the preferred embodiment, the bars are about equal in transverse cross-section.

The first bar member preferably provides an upper surface, a lower surface, front and rear surfaces.

In the preferred embodiment, the second bar member has an upper surface, a lower surface and front and rear surfaces. Notches on the second bar member communicate with at least the upper surface and the front and rear surfaces.

In the preferred embodiment, the first connector is pivotally connected to the first bar member.

The second connector can preferably provide an open center that is sized and shaped to receive both of the bar members when they are aligned and placed together.

Thus, the second connector has an open center, the open center being sized and shaped to enable each bar member to fit inside the open center when the two bar members are in either the angled or in the aligned, interference fit position.

At least one end of each bar member preferably provides a pliable bumper such as a rubber bumper.

The apparatus of the present invention is thus an adjustable bar assembly which can be sized and installed in a window or door frame or wall opening to secure a sheet of covering material that protects the glass of the window or door. The protective sheet is positioned in between glass portions of the window or door and the bracing devices. Flying debris resulting from a hurricane, tornado, or like other storm, strikes the protective sheet rather than the glass.

Each of the bracing devices comprises first and second independent and moveably connected bar members that can be selectively connected together and sized to fit the inside of a window or door opening. The adjustment can be made by the use of a hinge-like connector attached to the first bar and inserted into a notch on the second bar. Each bar can have an end with a rubber pad thereon to prevent marring the window or door opening and to prevent any slipping of the bar assembly.

A second connector can be in the form of a clip or locking ring for holding the first and second bars together to prevent movement once the bar assembly is in the selected, interference fit position.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2, 3, 4, 5, 6, 7:
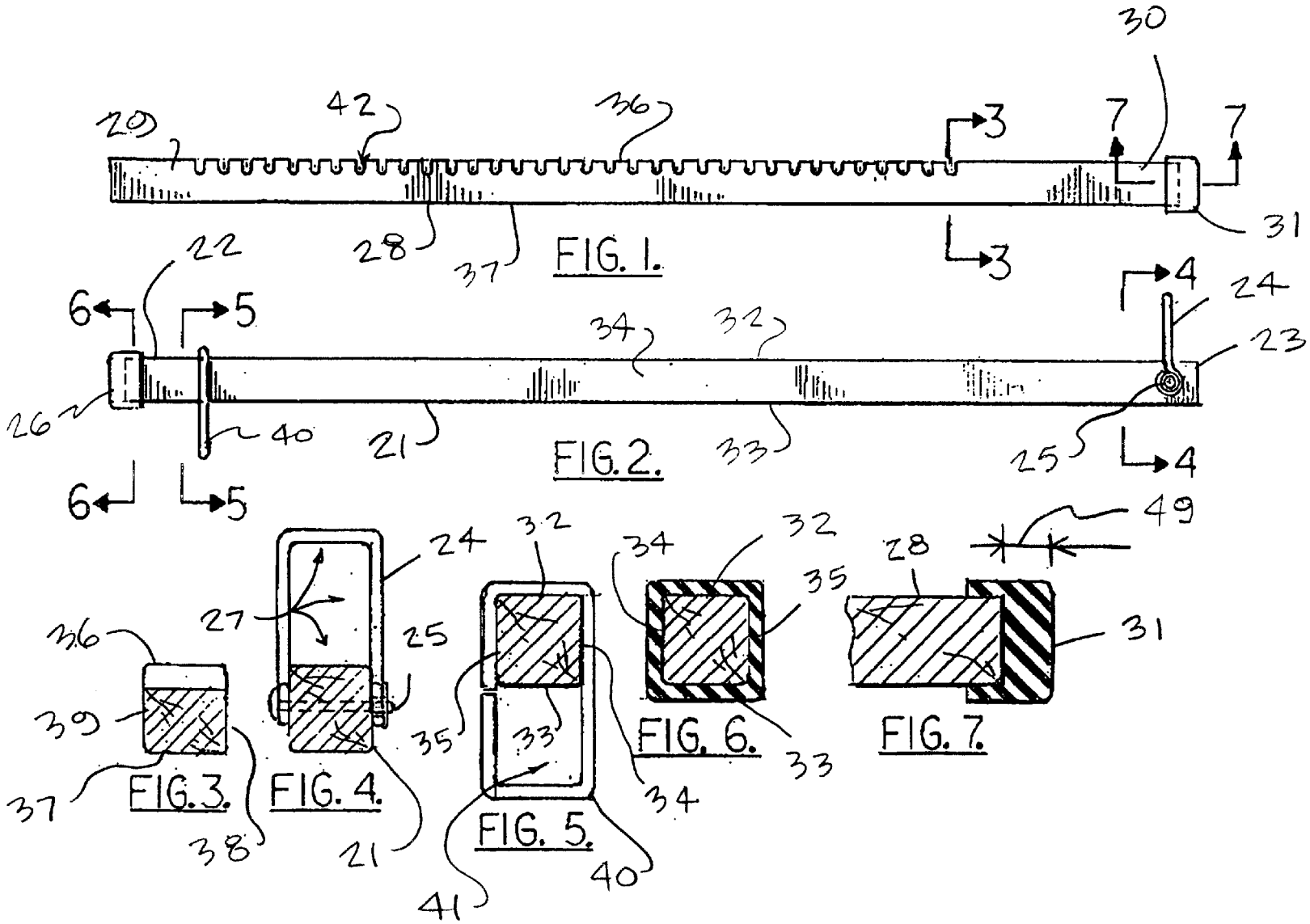
FIG. 1 is a partial front view of the preferred embodiment of the apparatus of the present invention.
FIG. 2 is a partial front view of the preferred embodiment of the apparatus of the present invention.
FIG. 3 is a sectional view taken along lines 3—3 of FIG. 1.
FIG. 4 is a sectional view taken along lines 4—4 of FIG. 2.
FIG. 5 is a sectional view taken along lines 5—5 of FIG. 2.
FIG. 6 is a sectional view taken along lines 6—6 of FIG. 2.
FIG. 7 is a sectional view taken along lines 7—7 of FIG. 1.
Figures 8A, 8B, 8C:
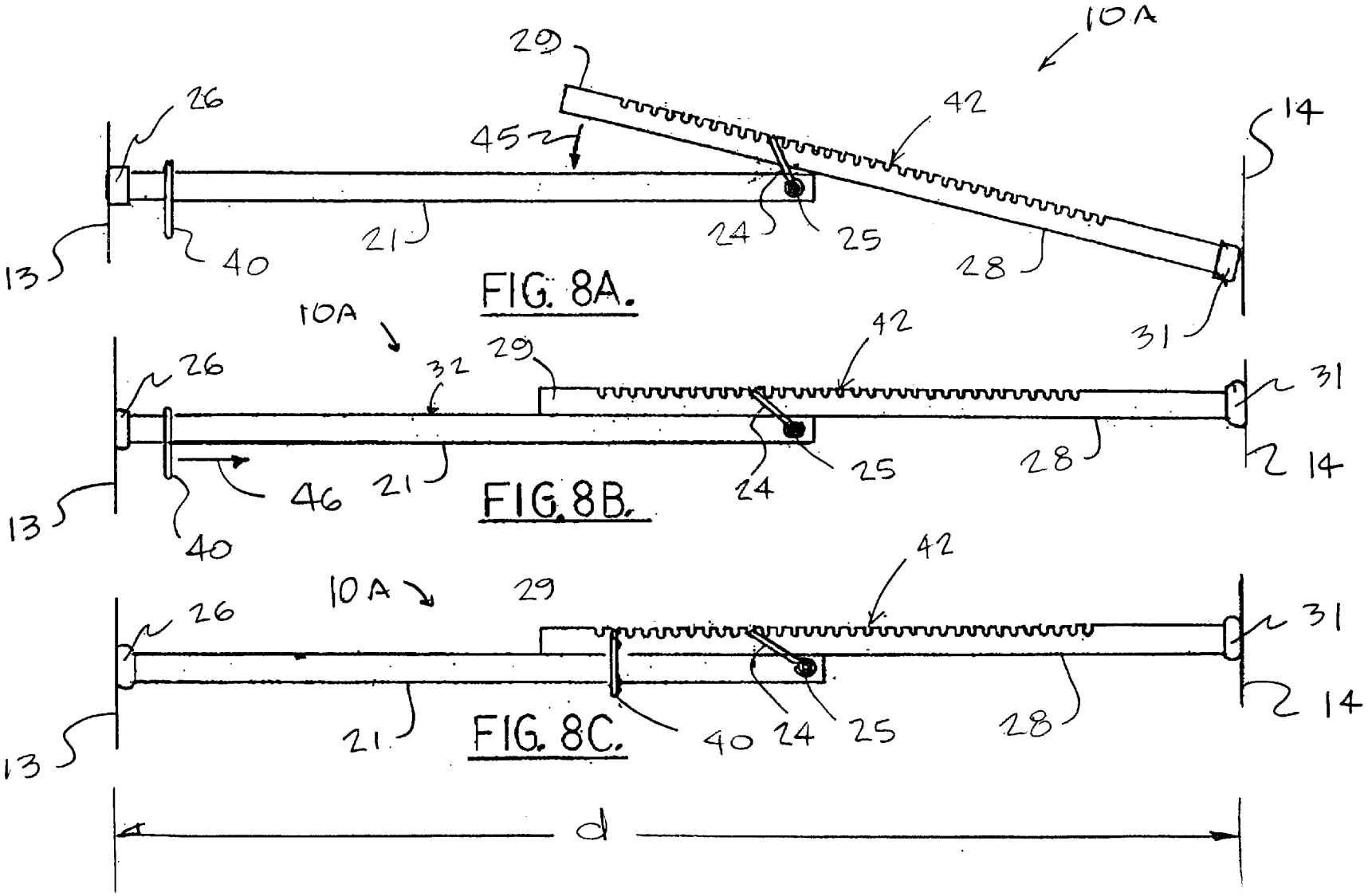
FIGS. 8A–8C are frontal views of the preferred embodiment of the apparatus of the present invention showing installation of the bracing device.
Figure 9:
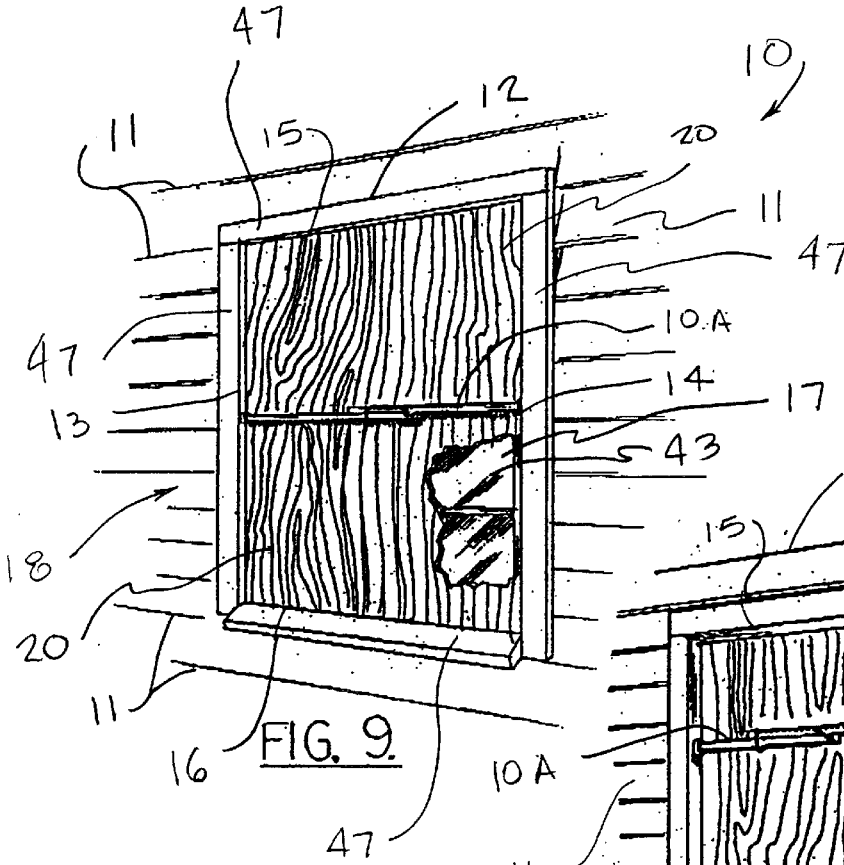
FIG. 9 is a perspective view of the preferred embodiment of the apparatus of the present invention installed in a window opening.
Figure 10:
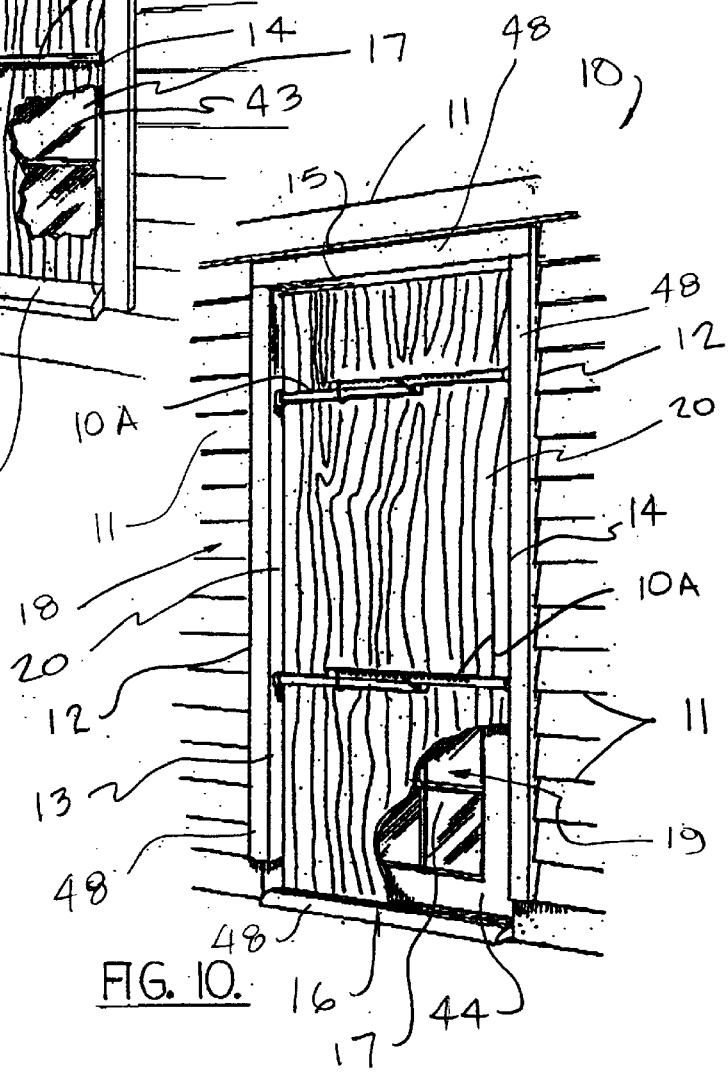
FIG. 10 is a perspective view of the preferred embodiment of the apparatus of the present invention installed in a door opening.

FIGS. 1–10 show the preferred embodiment of the apparatus of the present invention designated generally by the numeral 10 in FIGS. 9–10. Window protection apparatus 10 can be used to protect the glass portion of a window or a door that is mounted in a wall 11 of a building. Such a wall 11 typically provides a recess 12 into which the window or door is mounted. The building recess 12 is typically rectangular but can be another shape. In the drawings FIGS. 8A, 8B, 8C and 9–10, the recess 12 can be fitted with a window frame 47 or a door frame 48. Frames 47 and 48 are each provided with opposed, generally parallel vertical surfaces 13, 14, and opposed, generally parallel and horizontal surfaces 15, 16.

In the drawings, examples of a window frame 47 having window 43 (FIG. 9) and of a door frame 48 having door 44 (FIG. 10) are shown. In either case, such a window 43 or door 44 can have one or more glass panels 17 that occupy a vertical plane 19. The vertical plane 19 occupied by the glass panel 17 of the window 43 or door 44 can be generally parallel to and spaced from the vertical plane 18 defined by the wall 11 of the building.

In order to protect the glass panel or panels 17 of the window 43 or door 44, a protective rectangular (or selected shape) panel 20 can be fashioned of metal, plastic, wood, plywood or other structurally sound and protective material. The panel 20 is secured in place using one (See FIG. 9) or more (See FIG. 10) bracing devices 10A. Each bracing device 10A can include a first bar member 21, a second bar member 28 and connectors for assembling the bars 21, 28 together. Bar members 21 and 28 can be made of, for example, wood, but could also be made of plastic or other suitable material.

The first bar member 21 has end portions 22, 23, one of which is equipped with connector 24. The connector 24 can be pivotally attached at pivot 25 (e.g. bolt, rivet, shaft) to the first bar member 21. A bumper 26 such as a rubber bumper can be provided at end portion 22 of first bar member 21 that is opposite pivot 25 and connector 24. Connector 24 has an open center 27 that receives the bar members 21 and 28 when they are aligned together as shown in the drawings.

Second bar member 28 has end portions 29, 30. A bumper 31 can be attached to end portion 30. First bar member 21 has top surface 32, bottom surface 33, and front and rear surfaces 34, 35. The second bar member 28 provides a top surface 36, bottom surface 37, and front and rear surfaces 38, 39 respectively. A second connector 40 that is preferably in the shape of a rectangle or square d-ring provides an open center 41.

The second bar member 28 is provided with a plurality of spaced apart notches 42. The first connector 24 and the second connector 40 each form attachments to the second bar member at a selected one of the notches 42.

Operation of the apparatus 10 of the present invention can best be seen by viewing FIGS. 8A, 8B, 8C and 9–10.

In FIGS. 9 and 10, a window 43 or door 44 to be protected is first covered with a protective panel 20 of material such as plywood. The panel 20 is cut to fit within a window frame 47 or door frame 48. Once the panel 20 is placed within window frame 47 or door frame 48 as shown in FIGS. 9 and 10 respectively, a bracing device 10A is used to hold panel 20 in a position that covers the glass panels 17 of either the window 43 or the door 44.

In FIG. 9, a single bracing device 10A secures a panel 20 to protectively cover window 43. In FIG. 10, two bracing devices 10A are positioned at vertically spaced apart positions to secure panel 20 in a protective position over door 44.

In order to secure a bracing device 10A, the two bar members 21, 28 are preliminarily connected together using first connector 24 to engage a selected notch 42 as shown in FIG. 8A. The two bar members 21, 28 are angled with respect to each other as shown in FIG. 8 so that the overall length of the connected bar members 21, 28 is greater than the horizontal distance between the opposed surfaces 13, 14 of the window frame, or door frame 48. After the bar members 21, 28 are preliminarily connected together using connector 24, the user angles one of the bars 21, 28 with respect to the other. In FIG. 8A, the bar 28 is shown after placement at an angle of about 20 degrees with horizontal and also connected to the bar 21 using first connector 24. The bar member 21 is generally horizontally positioned in FIG. 8A. Because of this preliminary angular orientation of bar member 28 (see FIG. 8A), an interference fit can be achieved by rotating the end portion 29 of bar member 28 toward the bar member 21. In FIG. 8B, rotation in the direction of arrow 45 has been completed so that end portion 29 of bar member 28 is positioned next to the upper surface 32 of bar member 21. In this position of FIG. 8B, the bar members 21, 28 are aligned and at generally the same horizontal elevational position.

To perfect the interference fit, the first connector 24 is selectively placed in one of the notches 42 that enables the overall combined bar member length to slightly exceed the door frame width "d" (see FIG. 8C) when the two bar members 21, 28 are aligned. The rubber bumpers 26, 31 compress slightly to generate an interference or jam fit when the bar members 21, 28 are aligned. The connected bar members 21, 28 press tightly against the selected window frame 47 or door frame 48, wedging against the surfaces 13, 14 (see FIGS. 8B, 8C). As an example, in FIGS. 8A–8C, the horizontal distance between window or door frame surfaces 13 and 14 might equal 32", though in typical houses this distance might be 2 feet to 3 feet, and in some commercial buildings and some houses much longer (such as 4 feet to 10 feet). A notch 42 is selected for receiving connector 24 so that when the connected bar members 21, 28 are aligned (see FIGS. 8A, 8B), the combined length of the aligned (see FIG. 8B) bar members 21, 28 (without the bumpers 26, 31) is about 31 ½ inches. The bumpers 26, 31 can each extend a distance 49 (see FIG. 7 of about ½" beyond an end 23 or 29 of a bar member 21 or 28. With the bumpers, overall combined length of the brace device 10A is 32½". Thus, each bumper 26, 31 must compress ¼" generating an interference fit.

Bar members 21, 28 can each typically be about ¾" by about ¾" by about 22½" long for standard openings of about 2–3 feet, and larger when used in larger openings so that an adequate stiffness will be achieved. For example, in a 6 foot opening, bar members 21, 28 can each typically be about 1.5" by about 1.5" by about 40" long.

In FIG. 8C, second connector 40 has been positioned in a selected notch 42 that is next to end portion 29 of bar member 28. By so positioning the second connector 40, the bar members 21, 28 are maintained in the generally aligned position of FIGS. 8B and 8C.

The apparatus 10 of the present invention thus provides a protection for any window or door by securing a protective panel 20 over the glass panels 17 of the window 43 or door 44. By using the bracing devices 10A of the present invention, the panel 20 can be quickly secured in a protective position without a need for nails, wood screws, machine screws, or other fasteners that might damage the window 43, door 44 or their respective frames 47, 48.

Connectors other than connectors 40 (such as the locking rings shown in the provisional patent application whose priority is claimed herein) could be used to connect together bar members 21, 28.

Figure 11:
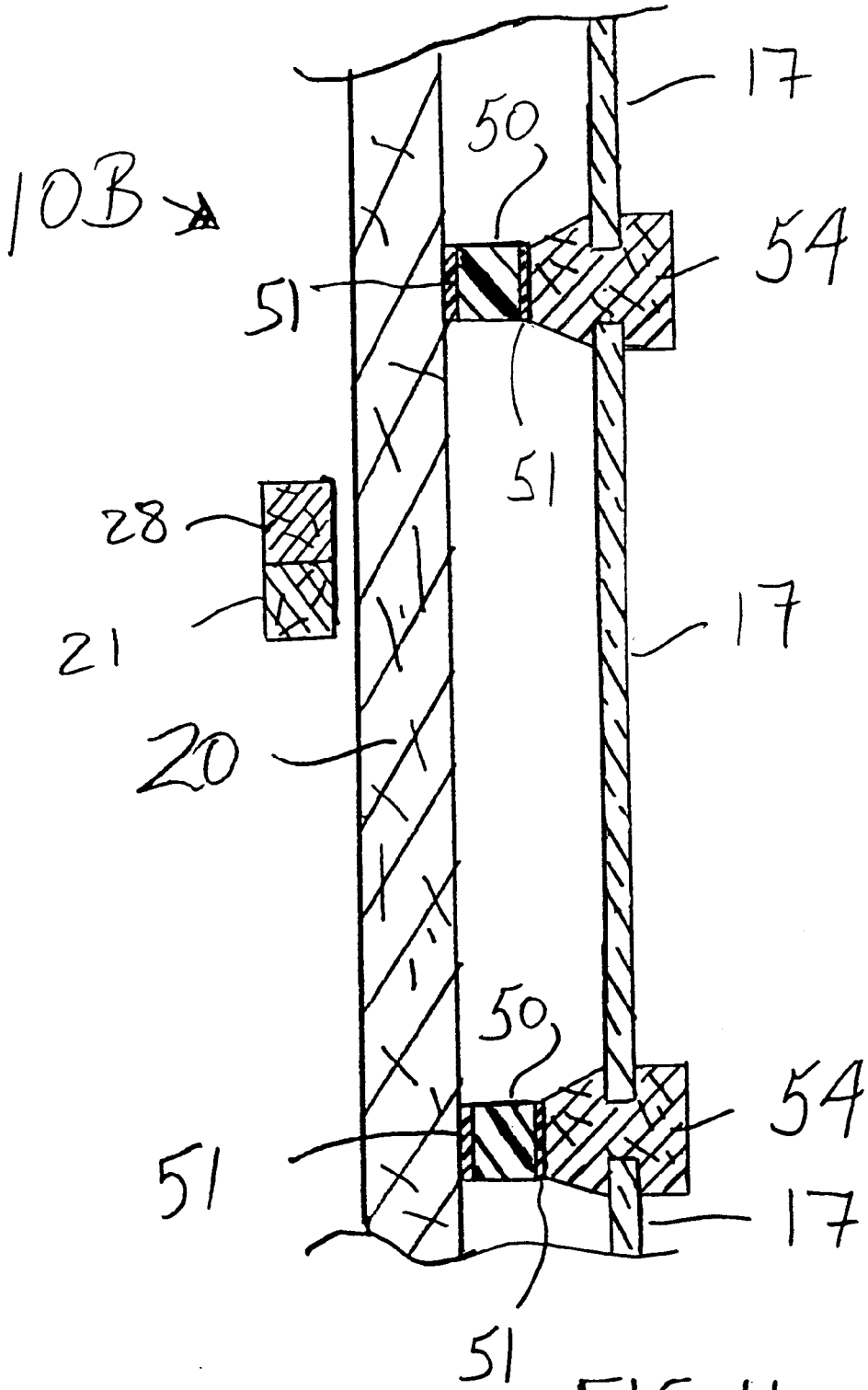
FIG. 11 is a cross-sectional view showing an embodiment of the invention which includes spacers.

FIG. 11 shows an embodiment 10B of the invention which includes spacers 50 to space protective panel 20 (made of, for example, ½" or ¾" thick plywood) away from the glass panel 17 to prevent panel 20 from striking glass panel 17 during a strong wind when impacted by a flying member. Spacers 50 can be made, for example, of 1 inch cubes polystyrene plastic with double-stick tape 51 attached to them to allow them to easily attach to the window sash 54 and/or to the protective panel 20. Suitable means other than double-stick tape 51 could be used to attach the spacers 50 to the window sash 54, the window frame, and/or the protective panel 20, and will be apparent to those skilled in the art.

The panels 20 are preferably sized to completely cover the windows and doors that they are designed to protect, though even panels which do not completely cover the windows and doors that they are designed to protect are better than no panels at all.

The following is a list of parts and exemplary materials suitable for use in the present invention:

| PARTS LIST: | |
|---|---|
| 10 | window protection apparatus |
| 10A | bracing device |
| 11 | wall |
| 12 | recess |
| 13 | vertical surface |
| 14 | vertical surface |
| 15 | horizontal surface |
| 16 | horizontal surface |
| 17 | glass panel |
| 18 | vertical plane |
| 19 | vertical plane |
| 20 | protective panel |
| 21 | first bar member |
| 22 | end |
| 23 | end |
| 24 | connector |
| 25 | pivot |
| 26 | bumper |
| 27 | connector open center |
| 28 | second bar member |
| 29 | end |
| 30 | end |
| 31 | bumper |
| 32 | top surface |
| 33 | bottom surface |
| 34 | front surface |
| 35 | rear surface |
| 36 | top surface |
| 37 | bottom surface |
| 38 | front surface |
| 39 | rear surface |
| 40 | second connector |
| 41 | open center |
| 42 | notch |
| 43 | window |
| 44 | door |
| 45 | arrow |
| 46 | arrow |
| 47 | window frame |
| 48 | door frame |
| 50 | spacers (such as polystyrene) |
| 51 | double-stick tape |
| 54 | window sash |

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. A window and door protection apparatus for protecting glass portions of a window or door placed in a recess of a wall of a building, comprising:

a) a sheet panel for covering the window or door, the panel being sized and shaped to fit over the window or door;

b) an adjustable retaining bar for securing the panel in the recess, the bar comprising:

i) a first bar member having first and second end portions, the first end portion having a first connector;

ii) a second bar member having first and second end portions and a plurality of spaced notches, wherein the notches define recess portions that enable a connection to be formed between the first connector and the second bar member at a selected position defined by a first selected notch;

iii) a second connector that enables a connection to be formed between the first bar member and the second bar member at a position spaced away from the first connector and at a location defined by a second selected notch, said second connector being capable of slidable movement along one of the first or second bar members and into the second selected notch;

c) wherein the bars are initially connectable in a first angled position using the first connector and selected notch, wherein both bars occupy the wall recess and wherein the bars are movable from the angled position to a generally aligned position that forms an interference fit with the building wall at the recess, the interference fit position of the bar enabling the bar to discourage removal of the panel from the recess.

2. The apparatus of claim 1 wherein the bars are about the same size.

3. The apparatus of claim 1 wherein the bars are about the same length.

4. The apparatus of claim 1 wherein the bars are about the same in transverse cross section.

5. The apparatus of claim 1 wherein the second bar member has an upper surface, a lower surface and front and rear surfaces, and wherein the notches are on the upper surface.

6. The apparatus of claim 1 wherein the first bar member has an upper surface, a lower surface and front and rear surfaces, and wherein the notches communicate with at least three of said upper, lower, front and rear surfaces.

7. The apparatus of claim 1 wherein the first connector is pivotally connected to the first bar member.

8. The apparatus of claim 1 wherein the second connector has an open center.

9. The apparatus of claim 8 wherein the open center is sized and shaped to enable each bar member to fit inside of the open center when the two bar members are abutted and aligned such as in the interference fit position.

10. The apparatus of claim 7 wherein the second connector has an open center, and the open center is sized and shaped to enable each bar member to fit inside of the open center when the two bar members are in either the angled or in the aligned, interference fit position.

11. The apparatus of claim 1 wherein an end of at least one of the bars has a pliable bumper.

12. The apparatus of claim 1 wherein an end of each of the bars has a pliable bumper.

13. A window and door protection apparatus for securing a protective panel to a window or door mounted in a recess of a wall of a building, comprising:

a) a first bar member having first and second end portions, the first end portion having a first connector;

b) a second bar member having first and second end portions and a plurality of notches spaced at intervals along at least a portion of the length of the second bar member, wherein the notches define recess portions that enable a connection to be formed between the first connector and the second bar member at a selected position defined by first selected notch;

c) a second connector that enables a connection to be formed between the first bar member and the second bar member at a position spaced away from the first connector; and d) wherein the bars are initially connected together using the first connector in an angled position so that both bars occupy the recess and wherein the angled bars are rotated from the angled position to a generally aligned position that forms an interference fit with the building wall at the recess, the interference fit position of the bar enabling the bar to discourage removal of the panel from the recess.

14. The apparatus of claim 13 wherein the bars are about the same size.

15. The apparatus of claim 13 wherein the bars are about the same length.

16. The apparatus of claim 13 wherein the bars are about the same in transverse cross section.

17. The apparatus of claim 13 wherein the first bar member has an upper surface, a lower surface, and front and rear surfaces, and wherein the notches are on the upper surface.

18. The apparatus of claim 13 wherein the first bar member has an upper surface, a lower surface and front and rear surfaces, and wherein the notches communicate with at least three of said upper, lower, front and rear surfaces.

19. The apparatus of claim 13 wherein the first connector is pivotally connected to the first bar member.

20. The apparatus of claim 13 wherein the second connector has an open center.

21. The apparatus of claim 13 wherein the open center is sized and shaped to enable each bar member to fit inside of the open center when the two bar members are abutted and aligned such as in the interference fit position.

22. The apparatus of claim 13 wherein the second connector has an open center, and the open center is sized and shaped to enable each bar member to fit inside of the open center when the two bar members are in either the angled or in the aligned, interference fit position.

23. The apparatus of claim 13 wherein an end of at least one of the bars has a pliable bumper.

24. The apparatus of claim 13 wherein an end of each of the bars has a pliable bumper.

25. A window and door protection apparatus for securing a protective panel to a window or door mounted in a recess of a wall of a building, comprising:

a) a first bar member having first and second end portions, the first end portion having a first connector;

b) a second bar member having first and second end portions and a plurality of notches, wherein the notches enable a connection to be formed between the first connector and the second bar member at a selected position defined by a first selected notch;

c) a second connector that enables a connection to be formed between the first bar member and the second bar member at a position spaced away from the first connector; and d) wherein the bars are initially connected together by the first connector in an angled position so that both bars occupy the recess and wherein the angled bars are moved from the angled position to form an interference fit with the building wall at the recess to discourage removal of the panel.

26. An apparatus for intended use in securing a protective structure over a window or door formed in an opening in a wall, comprising:

a first elongated bar;

a first connector carried by the elongated bar;

a second elongated bar having a plurality of notches, including a first selected notch for receiving the first connector when the first bar is initially positioned at an angle relative to the second bar in the wall opening;

a second connector for positioning in a second selected notch on the second bar after the first and second bars are moved from the angled position so as to create an interference fit with the wall surrounding the opening in which the window or door is positioned, said second connector being capable of slidable movement along one of the first or second bar members and into the second selected notch.

27. The apparatus of claim 26, wherein the first connector is pivotably mounted to one end of the first bar, wherein the first connector is initially pivoted to a first position when the first bar is initially positioned at an angle relative to the second bar and is pivoted to a second position when the first bar and the second bar are in the generally aligned position.

28. The apparatus according to claim 26, wherein the notches are formed in an upper surface of the second bar and the second bar is positioned above the first bar.

29. A method of holding a protective structure at least partially over a window or door positioned in an opening in a wall from damage during a storm or the like, comprising:

positioning first and second bars adjacent to the protective structure in the opening in an angled relationship;

positioning a first connector on the first bar in a first selected one of a plurality of notches formed in the second bar;

moving the first and second bars to an axially aligned relationship with the first connector positioned in the first selected notch such that the bars are held in place by an interference fit; and positioning a second connector in a second selected one of the plurality of notches to help maintain the first and second bars in the axially aligned relationship.

* * * * *

UNITED STATES PATENT AND TRADEMARK OFFICE

CERTIFICATE OF CORRECTION

PATENT NO. : 6,640,509 B2
DATED : November 4, 2003
INVENTOR(S) : Dale M. Clewis

It is certified that error appears in the above-identified patent and that said Letters Patent is hereby corrected as shown below:

Column 10,
Line 13, please replace “first” with -- second --.

Signed and Sealed this

Tenth Day of August, 2004

JON W. DUDAS
*Acting Director of the United States Patent and Trademark Office*